US009540942B2

(12) United States Patent
Zheng et al.

(10) Patent No.: US 9,540,942 B2
(45) Date of Patent: Jan. 10, 2017

(54) SHAFT SEALING SYSTEM FOR STEAM TURBINES

(75) Inventors: Xiaoqing Zheng, Niskayuna, NY (US); Daniel Robert Coffey, Schenectady, NY (US); Guoqiang Lu, Watervilet, NY (US); John Richard Powers, Scotia, NY (US); Steven Paul Scarlata, Wynantskill, NY (US); Christopher David Suttles, Greer, SC (US)

(73) Assignee: General Electric Company, Schenectady, NY (US)

( * ) Notice: Subject to any disclaimer, the term of this patent is extended or adjusted under 35 U.S.C. 154(b) by 833 days.

(21) Appl. No.: 13/446,707

(22) Filed: Apr. 13, 2012

(65) Prior Publication Data

US 2013/0272872 A1 Oct. 17, 2013

(51) Int. Cl.
*F01D 11/00* (2006.01)

(52) U.S. Cl.
CPC ..... *F01D 11/003* (2013.01)

(58) Field of Classification Search
CPC ..... F01D 11/003
See application file for complete search history.

(56) References Cited

U.S. PATENT DOCUMENTS

| | | | | |
|---|---|---|---|---|
| 3,003,321 | A * | 10/1961 | Warth | 60/688 |
| 3,873,817 | A | 3/1975 | Liang | |
| 3,885,822 | A | 5/1975 | Cohen et al. | |
| 3,906,730 | A * | 9/1975 | Bellati et al. | 60/657 |
| 3,945,760 | A | 3/1976 | Miller | |
| 4,350,345 | A * | 9/1982 | Kalan et al. | 277/347 |
| 5,137,284 | A * | 8/1992 | Holder | 277/390 |
| 5,344,160 | A | 9/1994 | Scarlata et al. | |
| 5,454,689 | A * | 10/1995 | Falavigna | 415/112 |
| 5,564,896 | A | 10/1996 | Beeck et al. | |
| 5,913,812 | A | 6/1999 | Smith et al. | |
| 6,293,553 | B1 | 9/2001 | Werner et al. | |
| 6,352,263 | B1 | 3/2002 | Gail et al. | |
| 6,695,314 | B1 | 2/2004 | Gail et al. | |
| 6,976,680 | B2 | 12/2005 | Uehara et al. | |
| 7,165,771 | B2 | 1/2007 | Beichl et al. | |
| 7,195,443 | B2 * | 3/2007 | Vandervort et al. | 415/1 |

(Continued)

FOREIGN PATENT DOCUMENTS

| | | | |
|---|---|---|---|
| CN | 87102697 | A | 10/1988 |
| CN | 1127327 | A | 7/1996 |

(Continued)

OTHER PUBLICATIONS

Office Action for U.S. Appl. No. 13/446,696, dated Feb. 17, 2015, 18 pages.

(Continued)

*Primary Examiner* — John K Fristoe, Jr.
*Assistant Examiner* — Brian O Peters
(74) *Attorney, Agent, or Firm* — Ernest G. Cusick; Hoffman Warnick LLC

(57) ABSTRACT

A shaft sealing system and method are disclosed for a high or intermediate pressure turbine section having a rotating member including a shaft and a stationary member surrounding the rotating member and defining a steam flow path. The shaft sealing system comprises at least one seal disposed about each of a first end and a second end of the shaft; and a connection line for conducting steam from the first turbine section to a downstream portion of the turbine. The downstream portion of the turbine is one of a low pressure section and a condenser, and has a lower pressure than both of the first turbine section and ambient pressure conditions.

18 Claims, 5 Drawing Sheets

(56) References Cited

U.S. PATENT DOCUMENTS

| | | | | |
|---|---|---|---|---|
| 7,226,053 | B2 | 6/2007 | Nakano et al. | |
| 7,445,212 | B2 | 11/2008 | Gail et al. | |
| 8,087,872 | B2 * | 1/2012 | Mehra et al. | 415/1 |
| 8,529,234 | B2 | 9/2013 | Yoshimura et al. | |
| 8,545,166 | B2 * | 10/2013 | Maruthamuthu | F01D 11/04 415/1 |
| 8,899,909 | B2 * | 12/2014 | Pandey et al. | 415/1 |
| 2010/0183439 | A1 * | 7/2010 | Ren | 415/230 |
| 2010/0284782 | A1 * | 11/2010 | Sanchez | 415/1 |

FOREIGN PATENT DOCUMENTS

| | | | |
|---|---|---|---|
| CN | 1410691 | A | 4/2003 |
| CN | 1431387 | A | 7/2003 |
| CN | 1573024 | A | 2/2005 |
| CN | 2833118 | Y | 11/2006 |
| CN | 201292865 | Y | 8/2009 |
| CN | 102362109 | A | 2/2012 |

OTHER PUBLICATIONS

State Intellectual Property Office of the People's Republic of China, Opinion Notice for First Examination for CN Serial No. 2015052801417530 dated Jun. 2, 2015,(English translation is included), 25 pages.

Peters, Office Action Communication for U.S. Appl. No. 13/446,696 dated Jun. 15, 2015, 19 pages.

Unofficial English translation of Office Action issued in connection with corresponding CN Application No. 201310129103.3 on Aug. 1, 2016.

* cited by examiner

SHAFT SEALING SYSTEM FOR STEAM TURBINES

CROSS REFERENCE TO RELATED APPLICATION

This patent application is related to commonly-assigned U.S. patent application Ser. No. 13/446,696, filed concurrently with this application.

BACKGROUND OF THE INVENTION

The invention relates generally to steam turbines, and more particularly, to a self-contained shaft sealing system for a steam turbine.

The pressure boundary of a steam turbine casing is penetrated by a rotating turbine shaft in order to transmit power generated by the turbine outside of the steam environment. Consequently, the shaft must be sealed at the points where it penetrates the casing in order to prevent steam from escaping, which may be dangerous to individuals in the area. The shaft seals must also prevent air from entering the casing, which would have detrimental effects on turbine performance.

A variety of shaft sealing systems have been employed including, for example, labyrinth seals disposed about the shaft ends. Labyrinth seals include teeth which enclose but do not contact the shaft, thus forming leakage paths between the seal and the shaft. Shaft sealing systems further include air seals, which function mainly to prevent air from entering the steam turbine. Disposed axially inward of the air seals are steam seals, which prevent steam from escaping to the outside of the steam turbine. To maintain a positive pressure difference across the air seal and the steam seal, accessories including piping systems, steam seal regulators, gland condensers, and auxiliary boilers are required to support turbine function. In some cases, a brush seal is used with labyrinth seals to reduce leakage, but the foregoing accessories remain necessary to provide proper turbine function. The gland condenser is employed to maintain a slight vacuum to draw out air that has passed the air seal in the direction of entering the casing, and to exhaust out steam that has passed the steam seal in the direction of exiting the casing. A seal header is typically maintained at a positive pressure and either supplies steam to the annulus inward of the steam seal or dumps steam from the annulus, as required in dependence upon whether steam leakage across the steam seal is exceeds or is exceeded by the leakage out of the internal section of the steam turbine. The positive pressure at the annulus inward of the steam seal precludes entry of air into the turbine.

As noted, labyrinth shaft sealing systems such as those described require the support of an extensive accessory system which does not contribute to the work performed by the turbine. These features increase the footprint of a plant, as well as the maintenance requirements without making any direct contribution to turbine output.

One alternative to labyrinth seals or brush seals is the use of carbon segmented circumferential seals or face seals, which have smaller effective clearances than the typical 0.75 mm to 1 mm clearances found in labyrinth seal designs. The clearances of labyrinth seals allow for particulate matter in the ambient air to pass through the seals without a problem. In seal system designs that utilize carbon seals having much smaller clearances, however, particulate matter may become trapped in the clearance space, causing seal damage. This presents a challenge, particularly for plants such as, for example, coal-fired plants where particulate matter such as coal dust is common in ambient air.

BRIEF DESCRIPTION OF THE INVENTION

A first aspect of the invention provides a shaft sealing system in a first turbine section having a rotating member including a shaft, and a stationary member surrounding the rotating member and defining a steam flow path. The shaft sealing system comprises at least one seal disposed about each of a first end and a second end of the shaft; and a first connection line for conducting steam from the first turbine section to a downstream portion of the turbine. The downstream portion of the turbine has a pressure below a pressure of the first turbine section, the first turbine section is at one of high pressure or intermediate pressure, and each of the first and the second ends of the shaft are at a pressure greater than atmospheric pressure.

A second aspect of the invention provides a shaft sealing system in a first turbine section having a rotating member including a shaft, and a stationary member surrounding the rotating member and defining a steam flow path. The shaft sealing system comprises at least one seal disposed about each of a first end and a second end of the shaft; a first buffer seal disposed axially outboard of the at least one seal disposed about the first end of the shaft; a second buffer seal disposed axially outboard of the at least one seal disposed about the second end of the shaft; and a first connection line for conducting steam from the first turbine section to a downstream portion of the turbine. The downstream portion of the turbine has a pressure below a pressure of the first turbine section, the first turbine section is at one of high pressure or intermediate pressure, and each of the first and the second ends of the shaft are at a pressure greater than atmospheric pressure.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

At least one embodiment of the present invention is described below in reference to its application in connection with the operation of a steam turbine. Although embodiments of the invention are illustrated relative to a steam turbine, it is understood that the teachings are equally applicable to other turbomachines including, but not limited to, compressors. Further, at least one embodiment of the present invention is described below in reference to a nominal size and including a set of nominal dimensions. However, it should be apparent to those skilled in the art that the present invention is likewise applicable to any suitable turbine and/or compressor. Further, it should be apparent to those skilled in the art that the present invention is likewise applicable to various scales of the nominal size and/or nominal dimensions.

As indicated above, aspects of the invention provide a shaft sealing system 100, different aspects of which are illustrated in FIGS. 1-5. Shaft sealing system 100 is self-contained in that the sealing system 100 seals the shaft of a turbine system at the points where the shaft penetrates the casing, preventing steam from escaping the casing and air from entering the casing, without the use of external supporting accessories such as piping systems, steam seal regulators, gland condensers, auxiliary boilers, and the like, which do not contribute to the work performed by the turbine. Therefore, a turbine system including self-contained shaft-sealing system 100 is unencumbered by the previously mentioned accessories and their associated drawbacks.

Figure 1:
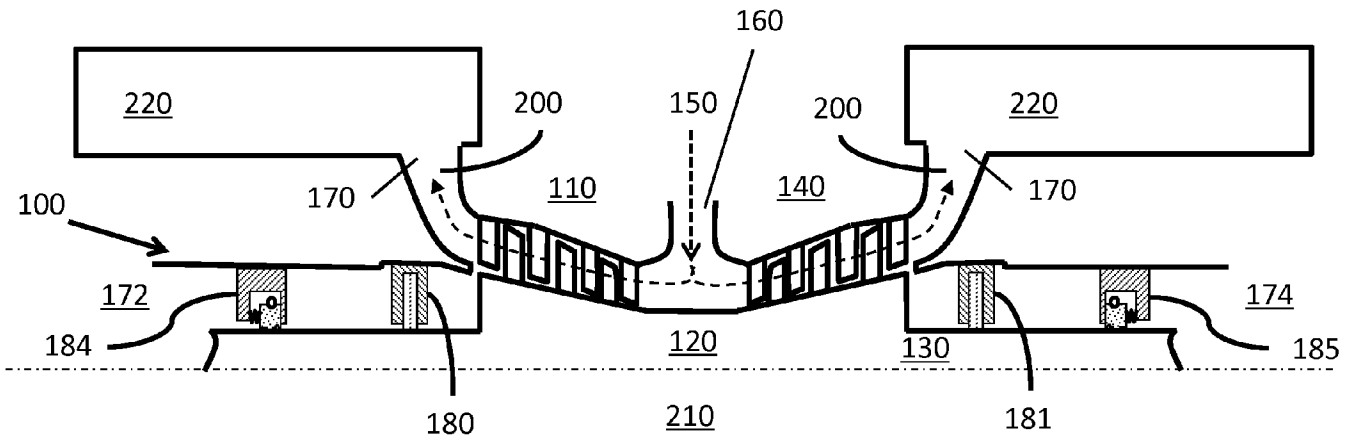
FIGS. 1-5 show shaft sealing systems in accordance with embodiments of the invention.
Figure 2:
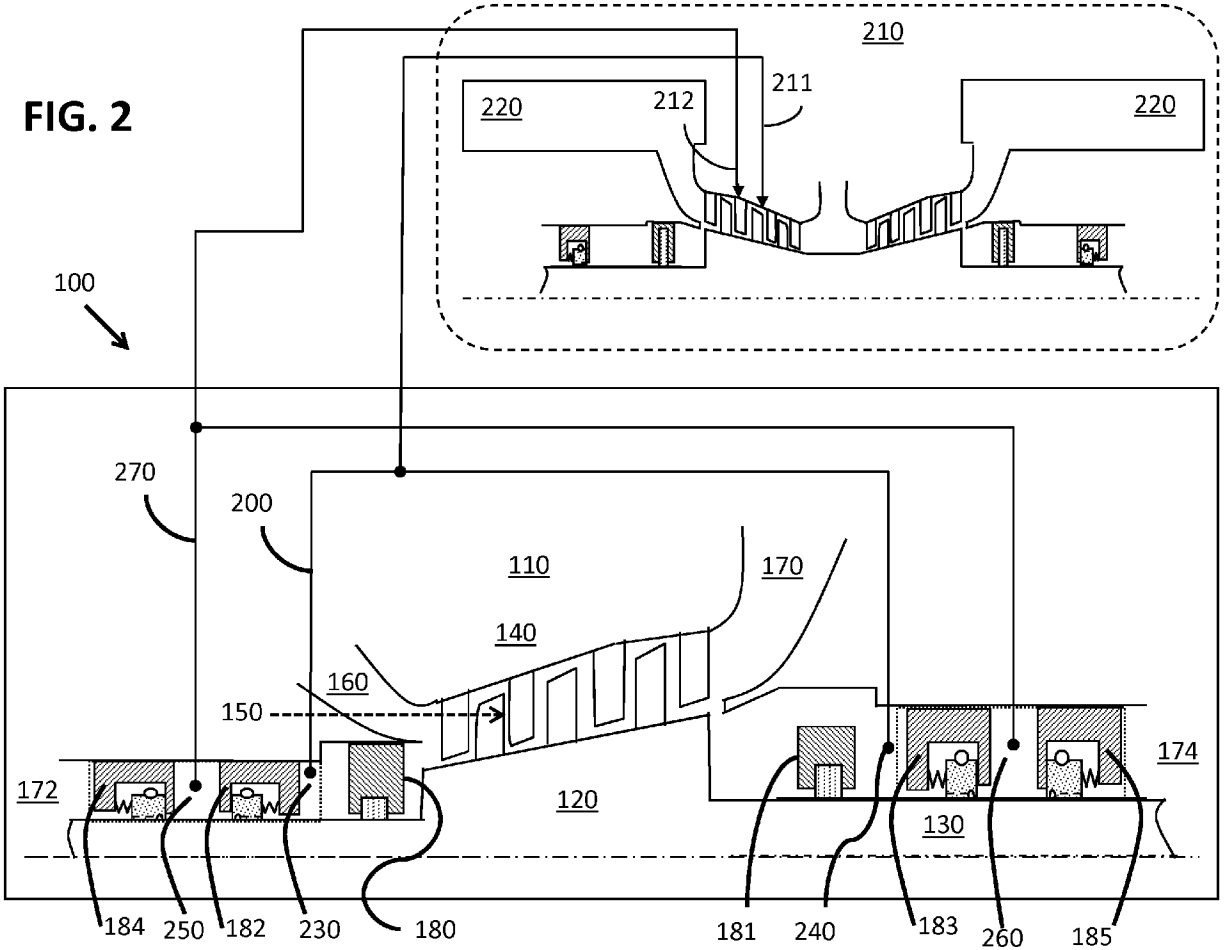
Figure 3:
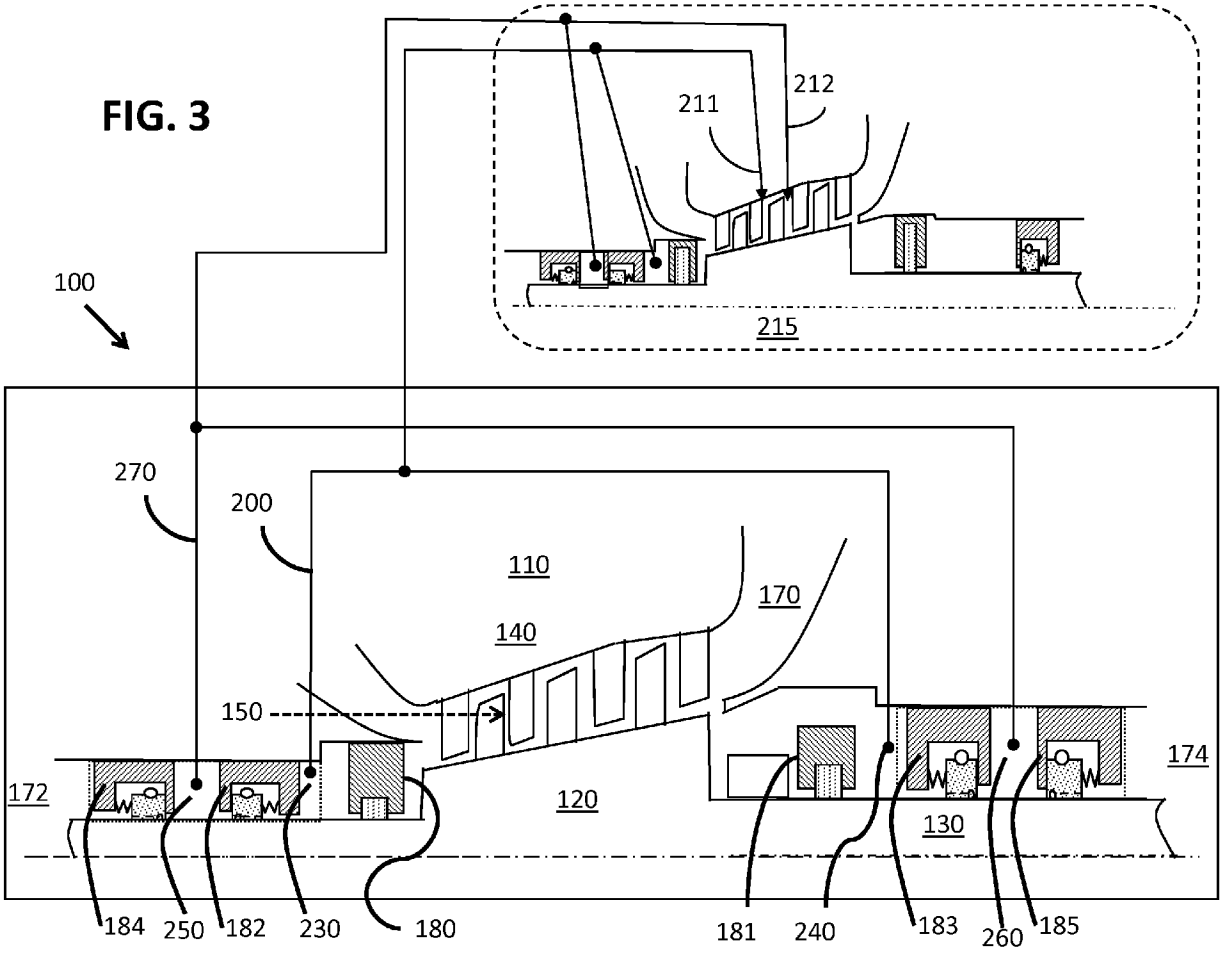
Figure 4:
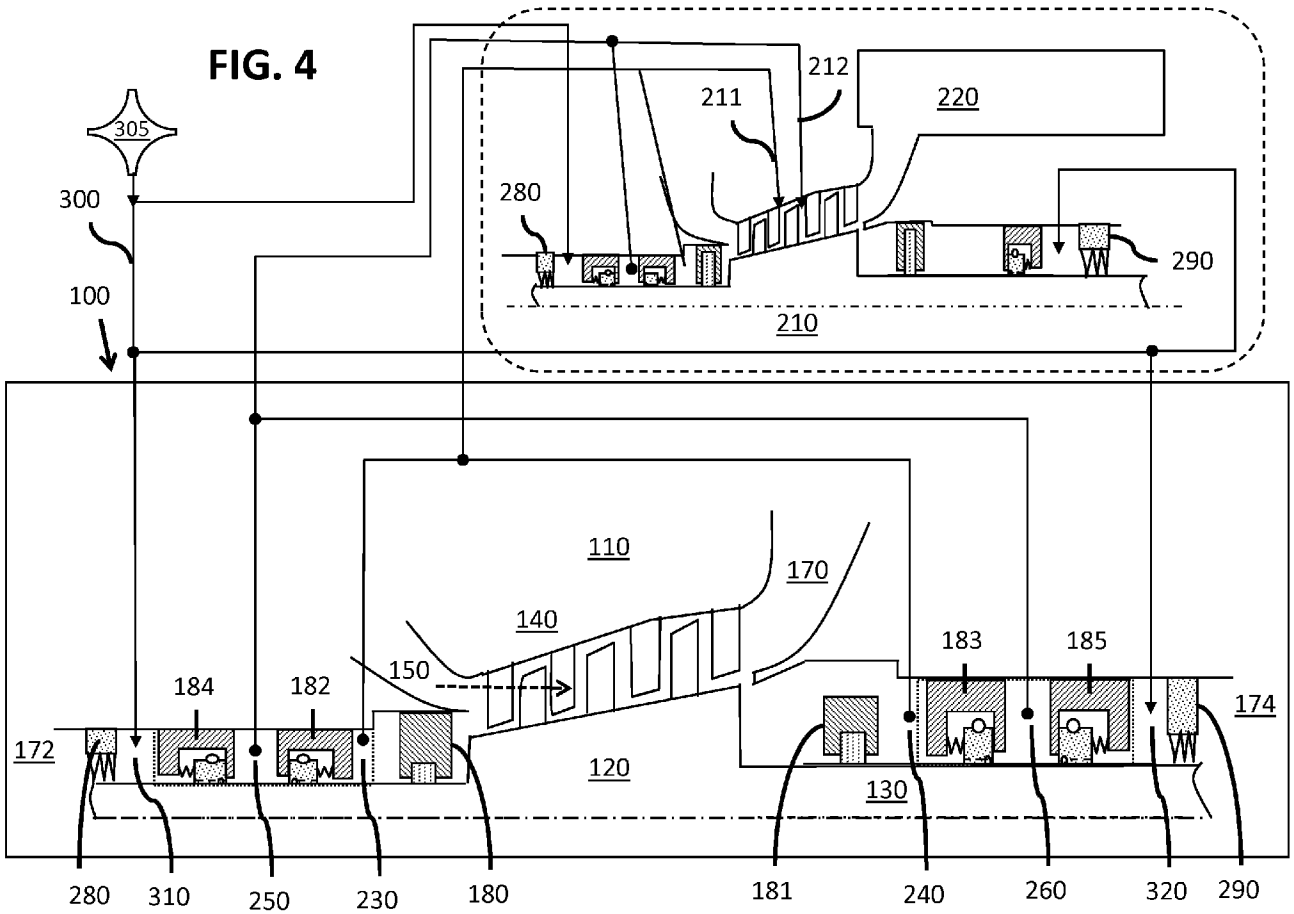
Figure 5:
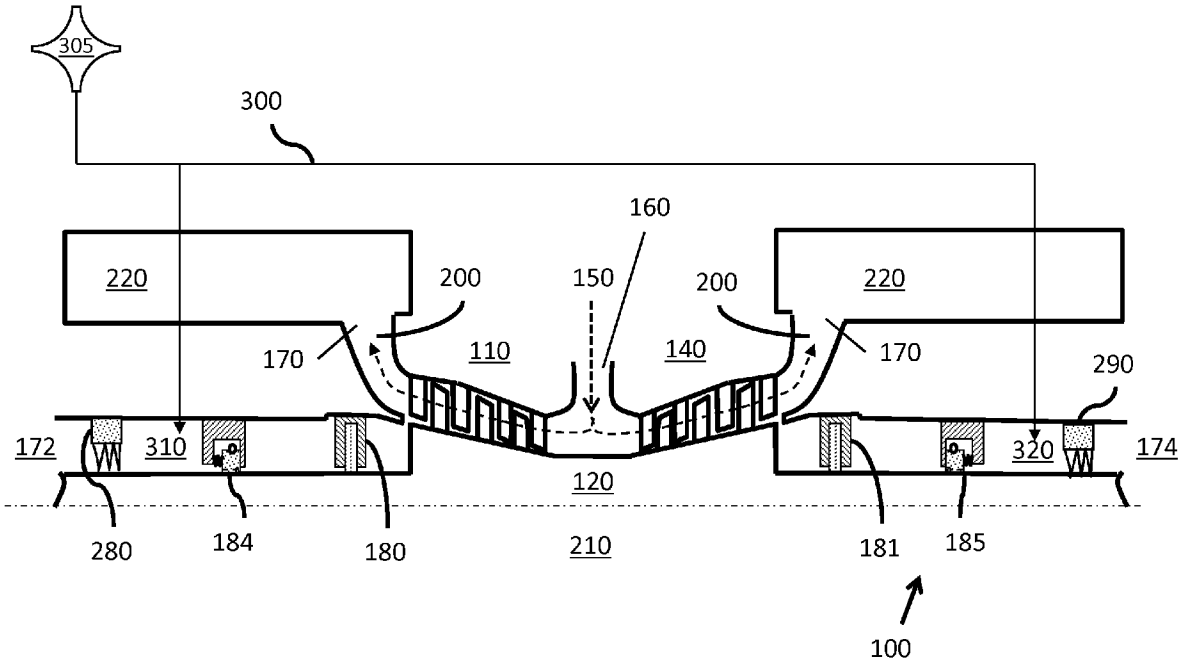

With reference to FIGS. 1-5, a first turbine section 110 is provided, having a rotating member 120 including a shaft 130, and a stationary member 140 surrounding the rotating member 120. Rotating member 120 and stationary member 140 may be any known rotor and stator structure, respectively. First turbine section 110 may be any of a variety of types of turbine sections including but not limited to a low pressure turbine section as shown in FIGS. 1 and 5, an intermediate pressure turbine section, a high pressure section, or a super high pressure section as shown in FIG. 2, or a high pressure or super high pressure turbine section as shown in FIGS. 3-4. Stationary member 140 further defines a steam flow path 150 having an inlet 160 and an outlet 170 of first turbine section 110. Shaft sealing system 100 is disposed about first and second ends 172, 174 of shaft 130.

Turning to the embodiment depicted in FIG. 1, first turbine section 110 may be a low pressure turbine section. In this embodiment, self-contained shaft sealing system 100 may include at least one seal, such as first main seal 180, disposed about first end 172, and at least one seal such as second main seal 181 disposed about second end 174 of shaft 130. First and second main seals 180, 181 may each include a single seal or a group of seals. First and second main seals 180, 181 may be designed to withstand the main pressure loading in the endpacking, i.e., they withstand significant pressure difference between either side of the seals 180, 181. First and second main seals 180, 181 may further include a plurality of packing rings, and in some embodiments may include leak-off lines between each of the plurality of packing rings that loop back into turbine sections to set pressure partition among seal groups and route leakage back to the flowpath to do more work.

As in the case of the double flow low pressure turbine section 110 in FIG. 1, a first connection line 200 may be provided at both outlets 170 as shown. First connection line 200 is provided for conducting steam from first turbine section 110 to a downstream portion of the turbine. Where, for example, first turbine section 110 is a low pressure turbine section, the downstream portion may be a condenser 220. As shown in the embodiment depicted in FIG. 1, first connection lines 200 may be disposed axially inboard of each of first and second main seals 180, 181, such that a substantial volume of steam is conducted downstream before reaching main seals 180, 181. First connection lines 200 also provide for flow passage in this case. The downstream portion of the turbine has a pressure that is lower than that of first turbine section 110, and each end 172, 174 of shaft 130 is maintained at a pressure lower than atmospheric or ambient pressure. Further, in the embodiment of FIG. 1, all pressure zones located along the axial length of shaft 130 between first end 172 and turbine exhaust, and second end 174 and turbine exhaust are at a pressure that is less than ambient pressure.

As further shown in FIG. 1, a first air seal 184 and second air seal 185 may be provided. First and second air seals 184, 185 may be disposed axially outboard of first and second main seals 180, 181 respectively. First and second air seals 184, 185 substantially prevent the ingress of ambient air into end packings disposed about shaft 130 ends 172, 174. Egress of steam is substantially prevented in this embodiment by main seals 180, 181 and by a pressure gradient drawing steam from outlet 170 of first turbine section 110 to condenser 220.

In operation, with reference to FIG. 1, steam enters first turbine section 110 at inlet 160, and follows steam path 150 through successive stages of first turbine section 110 to outlet 170. The comparatively low pressure of condenser 220 relative to the pressure in first turbine section 110 causes a majority of the steam to proceed along first connection lines 200 to condenser 220 via outlet 170. A small portion of steam may leak off, and rather than proceeding to outlet 170, may reach one of first or second main seals 180, 181. Main seals 180, 181, together with the decreasing pressure gradient from first turbine section 110 to condenser 220 substantially cause steam not escape beyond main seals 180, 181, and to be drawn back toward condenser 220.

Turning to the embodiment of FIGS. 2-3, in other embodiments first turbine section 110 may be one of a high pressure (HP) or intermediate pressure (IP) section, or a super high pressure (SHP) section in a super critical steam turbine. In such embodiments, self-contained shaft sealing system 100 may include at least one seal, such as first main seal 180, disposed about first end 172, and at least one seal, such as second main seal 181, disposed about second end 174 of shaft 130. Where, for example, first turbine section 110 is a SHP, HP, or IP turbine section, the downstream portion may be a low pressure turbine section 210 as shown in FIG. 2. In other embodiments such as that of FIG. 3, first turbine section 110 may be a HP or SHP turbine section, and the downstream portion may be a combined IP/LP turbine section 215 where the inlet end pressure is above ambient pressure while the exhaust end pressure is below ambient pressure.

With reference to both of FIGS. 2-3, the downstream portion of the turbine, i.e. low or intermediate pressure section 210 or 215, has a pressure that is lower than the lowest pressure in the first turbine section 110. In the embodiments of FIGS. 2-3, each end 172, 174 of shaft 130 is maintained at a pressure greater than atmospheric or ambient pressure. First and second main seals 180, 181 take the main pressure loading in the endpacking, i.e., they withstand significant pressure difference between either side of the first and second main seals 180, 181. Taking the example of first main seal 180 in FIG. 3, the pressure on the inside of first main seal 180, i.e. inside an HP first turbine section 110, may be about 16,547 kPa (about 2,400 psi), and the pressure on the outboard side of first main seal 180 may be as low as about 124 kPa (about 18 psi), depending on the downstream entry location of first stage 211. First and second main seals 180, 181 may further include a plurality of packing rings, and in some embodiments may include leak-off lines between each of the plurality of packing rings that loop back leakage into turbine sections to do more work.

With continued reference to FIGS. 2-3, first turbine section 110 may further include a first and second steam seal 182, 183 disposed axially outboard of each of the main seals 180, 181 at first and second ends 172, 174 respectively. First and second steam seals 182, 183 substantially prevent the egress of steam from first turbine section 110. A first annulus 230 may be disposed between first main seal 180 and first steam seal 182 at first end 172 of shaft 130; and a second annulus 240 may be disposed between second main seal 181 and second steam seal 183 at second end 174 of shaft 130.

A first connection line 200 may further be provided for conducting steam from first turbine section 110 to a downstream portion of the turbine. First connection line 200 is disposed such that a first end fluidly connects first and second annuli 230, 240 with each other and with a first stage in low pressure section 210 (FIG. 2) or combined IP/LP section 215 (FIG. 3). A first and second air seal 184, 185 may further be provided outboard of first and second steam seals respectively at each end 172, 174 of shaft 130. First and second air seals 184, 185 substantially prevent the ingress of air into end packings disposed about shaft 130 ends 172, 174. A third annulus 250 may be disposed between first air seal 184 and first steam seal 182 at first end 172 of shaft 130; and a fourth annulus 260 may be disposed between second air seal 185 and second steam seal 183 at second end 174 of shaft 130. Third and fourth annuli 250, 260 are fluidly connected by a second connection line 270, to one another and with a second stage 212 in low pressure section 210 (FIG. 2) or IP section 215 (FIG. 3) as applicable. The second stage 212 is downstream of first stage 211, and has a lower pressure than both ambient pressure and pressure of the first stage 211. This produces a stronger vacuum effect at third and fourth annuli 250, 260 than at first and second annuli 230, 240.

In operation, with reference to FIGS. 2-3, steam enters first turbine section 110 at inlet 160, and follows steam path 150 through successive stages of first turbine section 110 to outlet 170. The comparatively low pressure of low pressure section 210 (FIG. 2) or intermediate pressure section 215 (FIG. 3) relative to the pressure in first turbine section 110 causes a majority of the steam to proceed along to the respective lower pressure section 210, 215 via outlet 170. A small portion of steam may leak off, however, and rather than proceeding to outlet 170, may reach one of first or second main seals 180, 181. Main seals 180, 181, together with the decreasing pressure gradient from first turbine section 110 to intermediate 215 (FIG. 3) or low 210 (FIG. 2) pressure section reduces the amount of steam which may escape from flow path 150. A small amount of steam may escape beyond main seals 180, 181, however. First and second annuli 230, 240, in communication with first connection line 200, provide a conduit for delivering this steam into a first stage 211 of low pressure section 210 (FIG. 2) or IP section 215 (FIG. 3) as applicable. A vacuum is created at first and second annuli 230, 240, as a result of the comparatively low pressure in first stage 211 as compared to first and second annuli 230, 240, thus drawing the steam into low pressure section 210 (FIG. 2) or IP section 215 (FIG. 3) as applicable. First and second steam seals 182, 183 serve to further reduce the amount of steam which may escape first turbine section 110. Second connection line 270, together with third and fourth annuli 250, 260, provides a mechanism for capturing any steam which has escaped beyond first and second steam seals 182, 183 and the vacuum created at first and second annuli 230, 240. Second connection line 270 delivers steam from third and fourth annuli 250, 260 to a second stage 212 of low pressure section 210 (FIG. 2) or IP section 215 (FIG. 3) as applicable. Because second stage 212 is a later stage in low pressure section 210 (FIG. 2) or IP section 215 (FIG. 3), it has a lower pressure than first stage 211 and creates a stronger vacuum exists through second connection line 270 than first connection line 200. In this manner, first and second stages 211, 212 of low pressure section 210 (FIG. 2) or IP section 215 (FIG. 3) provide the necessary pressure gradient to substantially prevent the escape of steam from ends 172, 174, in connection with the previously described seals, using the pressure gradient inherently generated by the turbine system.

With reference to FIGS. 1-4, in various embodiments, each of the foregoing main seals 180, 181, steam seals 182, 183, and air seals 184, 185 disposed about first and second ends 172, 174 of shaft 130 may be a hydrodynamic non-contacting seal. In further embodiments, main seals 180, 181; steam seals 182, 183; and air seals 184, 185, as applicable to the various embodiments, may be one of a segmented circumferential seal or a face seal. The segmented circumferential seal or face seal may further be made of carbon. The steam seals 182, 183, and air seals 184, 185 may have very small clearances relative to shaft 130. For example, such clearances may be less than or equal to about 0.025 mm.

Turning to FIGS. 4-5, and with further reference to all of the foregoing embodiments, shaft sealing system 100 may further include a first buffer seal 280 disposed axially outward of the at least one seal, including main seal 180 and steam seal 182 and/or air seal 184 where present. Shaft sealing system 100 may further include a second buffer seal 290 disposed axially outward of the at least one seal, including second main seal 181 and steam seal 183 and/or air seal 185 where present.

In various embodiments, a filtered air supply 305 and a filtered air supply line 300 may further be provided. Filtered air supply line 300 may place filtered air supply 305 in fluid communication with each of a first cavity 310 and a second cavity 320, such that filtered air can be conducted from filtered air supply 305 to first and second cavities 310, 320. Filtered air supply line 300 provides clean, substantially particulate-free air to the environment, aiding in providing a tight seal with rotating member 120. First cavity 310 may be disposed between first buffer seal 280 and the axially outermost seal of the at least one seal 180, 182, 184; and second cavity 320 may be disposed between the second buffer seal 290 and the axially outermost seal of the at least one seal 181, 183, 185 where present. In operation, the introduction of filtered air via filtered air supply line 300 allows for tighter seals with rotating member 120, and less likelihood of steam leakage and air ingress. In the embodiments of FIGS. 4-5, for example, first cavity 310 is disposed between first air seal 184 and first buffer seal 280. Second cavity 320 is disposed between second buffer seal 290 and second air seal 185.

As further illustrated in FIG. 4, filtered air supply line 300 may deliver filtered air from filtered air supply 305 to each of first and second cavities 310, 320 in first turbine section 110, as well as similarly disposed first and second cavities 310, 320 in a downstream lower pressure section 210.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a turbine system including a first turbine section and a downstream section, each of the first turbine section and the downstream section having a respective rotating member including at least one stage mounted on a shaft, and each of the first turbine section and the downstream section further having a stationary member surrounding the respective rotating member and defining a steam flow path, a shaft sealing system, the shaft sealing system comprising: at least one seal disposed about each of a first end and a second end of the shaft of the first turbine section and being configured to prevent entry of ambient air into the first turbine section, wherein the at least one seal includes a main seal and a steam seal disposed axially outboard of the main seal, and wherein the at least one seal disposed about each of the first end and the second end of the shaft of the first turbine section comprises a hydrodynamic non-contacting seal comprising a carbon segmented circumferential seal; and a first connection line for conducting steam from the first turbine section to a first stage in the downstream section of the turbine system, the first stage having a lower operating pressure than the first turbine section such that during operation steam is drawn through, the first connection line from a first annulus disposed between the main seal and the steam seal about the first end of the shaft of the first turbine section and a second annulus disposed between the main seal and the steam seal about the second end of the shaft of the first turbine section to the first stage, wherein the downstream section of the turbine system is a distinct turbine section from the first turbine section, the downstream section of the turbine system being one of, a low pressure section of the turbine system, a combined intermediate pressure/low pressure section of the turbine system, or an intermediate pressure section of the turbine system, and the first turbine section being one of, a super high pressure section of the turbine system, a high pressure section of the turbine system, or an intermediate pressure section of the turbine system, and wherein the shaft sealing system does not require the use of a condenser other than a main condenser of the turbine system, and wherein an area about each of the first and the second ends of the shaft of the first turbine section inboard of the main seals are at a pressure greater than atmospheric pressure.

2. The shaft sealing system of claim 1, wherein the first turbine section is the intermediate pressure section of the turbine system.

3. The shaft sealing system of claim 1, wherein the downstream section is the low pressure section of the turbine system.

4. The shaft sealing system of claim 1, wherein the first turbine section is the high pressure section of the turbine system, and wherein the downstream section is the combined intermediate/low pressure section of the turbine system.

5. The shaft sealing system of claim 1, wherein each of the at least one seal disposed about each of the first end and the second end of the shaft of the first turbine section further comprises: an air seal disposed axially outboard of each of the steam seals, and the shaft sealing system further includes: a third annulus disposed between the steam seal and the air seal about the first end of the shaft of the first turbine section and a fourth annulus disposed between the steam seal and the air seal about the second end of the shaft of the first turbine section, and a second connection line fluidly connecting the second annulus to a second stage of the downstream section, wherein the second stage has a lower pressure than the first stage.

6. The shaft sealing system of claim 1, wherein each of the at least one seal disposed about each of the first end and the second end of the shaft of the first turbine section has a clearance distance from the rotating member that is less than or equal to about 0.025 mm.

7. The shaft sealing system of claim 1, further comprising a first buffer seal disposed axially outboard of the at least one seal disposed about the first end of the shaft of the first turbine section; a second buffer seal disposed axially outboard of the at least one seal disposed about the second end of the shaft of the first turbine section; and a filtered air supply line providing filtered air to each of a first cavity disposed between the first buffer seal and the at least one seal about the first end of the shaft of the first turbine section, and a second cavity disposed between the second buffer seal and the at least one seal about the second end of the shaft of the first turbine section.

8. The shaft sealing system of claim 1, wherein the first turbine section is the intermediate pressure section of the turbine system, and wherein the downstream section of the turbine system is the low pressure section of the turbine system.

9. The shaft sealing system of claim 1, wherein the first turbine section is the super high pressure section of the turbine system, and wherein the downstream section of the turbine system is the intermediate pressure section of the turbine system.

10. In a turbine system including a first turbine section and a downstream section, each of the first turbine section and the downstream section having a respective rotating member including at least one stage mounted on a shaft, and each of the first turbine section and the downstream section further having a stationary member surrounding the respective rotating member and defining a steam flow path, a shaft sealing system, the shaft sealing system comprising: at least one seal disposed about each of a first end and a second end of the shaft of the first turbine section and being configured to prevent entry of ambient air into the first turbine section, wherein the at least one seal includes a main seal and a steam seal disposed axially outboard of the main seal, and wherein the at least one seal disposed about each of the first end and the second end of the shaft of the first turbine section comprises a hydrodynamic non-contacting seal comprising a carbon segmented circumferential seal; a first buffer seal disposed axially outboard of the at least one seal disposed about the first end of the shaft of the first turbine section; a second buffer seal disposed axially outboard of the at least one seal disposed about the second end of the shaft of the first turbine section; and a first connection line for conducting steam from the first turbine section to a first stage in the downstream section of the turbine system, the first stage having a lower operating pressure than the first turbine section such that during operation steam is drawn through, the first connection line from a first annulus disposed between the main seal and the steam seal about the first end of the shaft of the first turbine section and from a second annulus disposed between the main seal and the steam seal about the second end of the shaft of the first turbine section to the first stage, wherein the downstream section of the turbine system is a distinct turbine section from the first turbine section, the downstream section of the turbine system being one of: a low pressure section of the turbine system, a combined intermediate pressure/low pressure section of the turbine system, or an intermediate pressure section of the turbine system, and the first turbine section being one of: a super high pressure section of the turbine system, a high pressure section of the turbine system, or an intermediate pressure section of the turbine system, and wherein the shaft sealing system does not require the use of a condenser other than a main condenser of the turbine system, and wherein an area about each of the first and the second ends of the shaft of the first turbine section inboard of the main seals are at a pressure greater than atmospheric pressure.

11. The shaft sealing system of claim 10, wherein the downstream section is the low pressure section of the turbine system.

12. The shaft sealing system of claim 10, wherein each of the at least one seal disposed about each of the first end and the second end of the shaft of the first turbine section further comprises: an air seal disposed axially outboard of each of the steam seals, and the shaft sealing system further includes a third annulus disposed between the steam seal and the air seal about the first end of the shaft of the first turbine section and a fourth annulus disposed between the steam seal and the air seal about the second end of the shaft of the first turbine section, and a second connection line fluidly connecting the second annulus to a second stage of the downstream section, and wherein the second stage has a lower pressure than the first stage.

13. The shaft sealing system of claim 10, wherein each of the at least one seal disposed about each of the first end and the second end of the shaft of the first turbine section has a clearance distance from the rotating member that is less than or equal to about 0.025 mm.

14. The shaft sealing system of claim 10, wherein the first turbine section is the intermediate pressure section of the turbine system, and wherein the downstream section of the turbine system is the low pressure section of the turbine system.

15. The shaft sealing system of claim 10, wherein the first turbine section is the super high pressure section of the turbine system, and wherein the downstream section of the turbine system is the intermediate pressure section of the turbine system.

16. A method for, in a turbine system including a first turbine section and a downstream section with each of the first turbine section and the downstream section having a respective rotating member including at least one stage mounted on a rotating shaft and a stationary member surrounding the respective rotating shaft and defining a steam flow path, sealing the shaft of the first turbine section, the method comprising: providing at least one seal disposed about each of a first end and a second end of the shaft of the first turbine section, including configuring the at least one seal to prevent entry of ambient aft into the first turbine section, wherein the providing at least one seal includes providing a main seal and providing a steam seal disposed axially outboard of the main seal, and wherein the providing at least one seal further includes providing a hydrodynamic non-contacting seal comprising a carbon segmented circumferential seal; and conducting steam from the first turbine section to a first stage in the downstream section of the turbine system via a first connection line, the first stage having a lower operating pressure than the first turbine section, including connecting the first connection line to the first stage such that the first stage acts as a vacuum source, connecting a first annulus disposed between the main seal and the steam seal about the first end of the shaft of the first turbine section and connecting the first connection line to a second annulus disposed between the main seal and the steam seal about the second end of the shaft of the first turbine section, wherein the downstream section of the turbine system is a distinct turbine section from the first turbine section, the downstream section of the turbine system being one of, a low pressure section of the turbine system, a combined intermediate pressure/low pressure section of the turbine system, or an intermediate pressure section of the turbine system, and the first turbine section being one of, a super high pressure section of a turbine system, a high pressure section of the turbine system, or an intermediate pressure section of the turbine system, and wherein the shaft of the first turbine section sealing system does not require the use of a condenser other than a main condenser of the turbine system, and wherein an area about each of the first and the second ends of the shaft of the first turbine section inboard of the main seals in the first turbine section are at a pressure greater than atmospheric pressure.

17. The method of claim 16, wherein the providing the at least one seal disposed about each of the first end and the second end of the shaft of the first turbine section further comprises; providing an air seal disposed axially outboard of each of the steam seals; fluidly connecting the first annulus disposed between the main seal and the steam seal at each of the first end and the second end of the shaft of the first turbine section, with the first stage of the downstream section; and fluidly connecting the second annulus disposed between the steam seal and the air seal at each of the first end and the second end of the shaft of the first turbine section, with a second stage of the downstream section, wherein the second stage has a lower pressure than the first stage.

18. The method of claim 16, further comprising: providing a first buffer seal disposed axially outboard of the at least one seal disposed about the first end of the shaft of the first turbine section; providing a second buffer seal disposed axially outboard of the at least one seal disposed about the second end of the shaft of the first turbine section; and providing filtered air to each of a first cavity disposed between the first buffer seal and the at least one seal, and a second cavity disposed between the second buffer seal and the at least one seal.

* * * * *